US007823330B2

(12) United States Patent
Ostrowski et al.

(10) Patent No.: US 7,823,330 B2
(45) Date of Patent: Nov. 2, 2010

(54) APPARATUS AND METHOD FOR DRUMS IN A SLIDING DOOR MECHANISM

(75) Inventors: Artur J. Ostrowski, Rochester Hills, MI (US); Kevin Wright, Detroit, MI (US); Jae-Joung Im, Yongin-si (KR); Daniela L. Kowalski, Shelby Township, MI (US)

(73) Assignee: Strattec Power Access LLC, Troy, MI (US)

( * ) Notice: Subject to any disclaimer, the term of this patent is extended or adjusted under 35 U.S.C. 154(b) by 782 days.

(21) Appl. No.: 11/674,553

(22) Filed: Feb. 13, 2007

(65) Prior Publication Data

US 2007/0209283 A1 Sep. 13, 2007

Related U.S. Application Data

(60) Provisional application No. 60/780,549, filed on Mar. 9, 2006, provisional application No. 60/840,358, filed on Aug. 25, 2006.

(51) Int. Cl.
*E05F 11/00* (2006.01)

(52) U.S. Cl. ..... 49/360; 296/155

(58) Field of Classification Search ..... 49/360, 49/324, 352; 242/157.1, 407, 579; 296/155
See application file for complete search history.

(56) References Cited

U.S. PATENT DOCUMENTS 4,534,233 A * 8/1985 Hamaguchi ..... 74/89.2
4,628,759 A * 12/1986 Kobayashi et al. ..... 74/501.5 R
4,840,080 A * 6/1989 Kobayashi et al. ..... 74/501.5 R
4,899,608 A * 2/1990 Knappe et al. ..... 74/411
5,046,283 A 9/1991 Compeau et al.
5,138,795 A * 8/1992 Compeau et al. ..... 49/138
5,313,795 A 5/1994 Dunn
5,319,880 A * 6/1994 Kuhlman ..... 49/360
5,319,881 A * 6/1994 Kuhlman ..... 49/360
5,323,570 A 6/1994 Kuhlman et al.
6,038,818 A * 3/2000 Haag et al. ..... 49/360
6,052,946 A * 4/2000 Isomura ..... 49/352
6,408,573 B1 * 6/2002 Fukumoto et al. ..... 49/360
6,918,209 B2 * 7/2005 Regnier et al. ..... 49/352
6,925,757 B2 * 8/2005 Priest et al. ..... 49/360

* cited by examiner

*Primary Examiner*—Katherine W Mitchell
*Assistant Examiner*—Catherine A Kelly
(74) *Attorney, Agent, or Firm*—Michael Best & Friedrich LLP

(57) ABSTRACT

A cable drum assembly for a power drive assembly for a vehicle sliding door, the cable drum assembly comprising: a first drum configured for use as a front drum or a rear drum of the cable drum assembly, the first drum having a first plurality of locating holes; and a second drum configured for use as a front drum or a rear drum of the cable drum assembly, the second drum having a second plurality of locating holes, the first plurality of locating holes have a first pair of locating holes configured to align with a first pair of location holes of the second plurality of locating holes when the first drum is used as a rear drum of the drum assembly and the second drum is used as a front drum of the drum assembly and the second plurality of locating holes have a second pair of locating holes configured to align with a second pair of location holes of the first plurality of locating holes when the first drum is used as a front drum of the drum assembly and the second drum is used as a rear drum of the drum assembly.

20 Claims, 8 Drawing Sheets

APPARATUS AND METHOD FOR DRUMS IN A SLIDING DOOR MECHANISM

CROSS REFERENCE TO RELATED APPLICATIONS

This application claims the benefit of U.S. Provisional Patent Application Ser. No. 60/780,549 filed Mar. 9, 2006, the contents of which are incorporated herein by reference thereto.

This application also claims the benefit of U.S. Provisional Patent Application Ser. No. 60/840,358 filed Aug. 25, 2006, the contents of which are incorporated herein by reference thereto.

BACKGROUND

The present application relates to vehicle doors and more particularly the present application relates to a drum assembly for a power sliding door mechanism.

A typical vehicle is manufactured with a plurality of openable doors. Each door is typically mounted on hinges within a door opening. Some larger vehicles have sliding doors that slide from an open position to a closed position thus, egress and ingress of the vehicle is possible without requiring a large open area beside the vehicle to allow for pivoting of the door. This is particularly useful in parking lots where the area between the vehicles is typically not large enough to allow for full pivoting of the opening doors. Moreover, such sliding doors also allow the vehicles to have larger door openings.

Accordingly, sliding doors provide access to large door openings without requiring a large area adjacent to the vehicle, which would be required for a door that pivots on its hinge. In one configuration, a power sliding door is supported and guided by an upper track, a center track and a lower track. An upper roller is attached to the power sliding door and travels in the upper track. A lower roller is attached to a lower portion of the sliding door and runs or travels in the lower track. A hinge and roller assembly is pivotally attached to a rear portion (e.g., towards the rear of the vehicle) of the door between the upper and lower portions of the door. The hinge and roller assembly is also received in the track to allow for sliding or movement of the door.

In addition, some vehicles are equipped with sliding doors on opposite sides of a vehicle.

In addition to the usage of sliding doors in vehicles, power drive systems have been implemented wherein automatic opening, closing, locking and unlocking of the sliding door is facilitated through a drive system coupled to the sliding door. Presently, some sliding doors are driven through cables attached to the forward and aft sides of the center roller hinge (e.g., a hinge mounted towards the center of the door with respect to the upper and lower edges of the same).

Drum assemblies are used to wrap up and release a portion of the cable as the sliding door is opened and closed. The drum assemblies have a front drum and a rear drum each mounted coaxially with each other. During closing of the sliding door with the driving assembly there is an increase force at the end of the door closing using the front drum with a variable moment arm (cam) feature configured to wrap up a portion of the cable. This causes excessive cable slack unless it is not compensated for by the rear drum. In order to compensate for this excessive slack, the rear drum has a variable radius (cam) feature that is similar to the front drum.

In order to provide power drive assemblies for a vehicle having both a left hand vehicle sliding door and a right hand vehicle sliding door a pair of systems will require a total of four different drums and assembly tools (e.g., a front drum and a rear drum for both the left hand and right hand power drive assemblies). Also, and since the drums are very similar in shape and size they could easily be mixed during assembly.

Accordingly, it is desirable to provide a pair of drums for use as either a right hand side or left hand side drum assembly. Moreover, it is also desirable to provide a method for using and assembling the drums for either a left hand or right hand drum assembly of a power drive system.

SUMMARY OF THE INVENTION

In one exemplary embodiment, a cable drum assembly is provided wherein the cable drum assembly has two symmetrically opposite drums with some differencing features. In accordance with an exemplary embodiment each drum has provisions to mount on a front cable and on a rear cable of a sliding door drive assembly. One of the drums can be used on a front cable of a right hand door vehicle drive unit and a rear cable of a left hand door vehicle drive unit while the other drum can be used as a front on a left hand door vehicle drive unit and a rear of a right hand door vehicle drive unit.

A cable drum assembly for a power drive assembly for a vehicle sliding door is provided, the cable drum assembly comprising: a first drum configured for use as a front drum or a rear drum of the cable drum assembly, the first drum having a first plurality of locating holes; and a second drum configured for use as a front drum or a rear drum of the cable drum assembly, the second drum having a second plurality of locating holes, the first plurality of locating holes have a first pair of locating holes configured to align with a first pair of location holes of the second plurality of locating holes when the first drum is used as a rear drum of the drum assembly and the second drum is used as a front drum of the drum assembly and the second plurality of locating holes have a second pair of locating holes configured to align with a second pair of location holes of the first plurality of locating holes when the first drum is used as a front drum of the drum assembly and the second drum is used as a rear drum of the drum assembly.

A method for providing an error proof assembly of a cable drum assembly for a power drive assembly for a vehicle sliding door is also provided, the method comprising: inserting a pair of locating pins of a tool into a housing of a power drive assembly; inserting a first drum configured for use as a front drum or a rear drum of the cable drum assembly into the housing, the pair of locating pins being received within a first pair of locating holes of a first plurality of locating holes of the first drum; inserting a second drum configured for use a front drum or a rear drum of the cable drum assembly into the housing after the first drum has been inserted therein, the pair of locating pins being received within a first pair of locating holes of a second plurality of locating holes of the second drum and the power drive assembly is configured for use on only one side of the vehicle and the first plurality of locating holes and the second plurality of locating holes each comprise a second pair of locating holes configured to align with each other when the second drum is inserted into another housing first and the first drum is inserted thereafter, the second pair of locating holes of the first and second drum having being arranged at a distance greater or less than the a distance between the first pair of locating holes of the first and second drum.

In another exemplary embodiment a method for providing an error proof assembly of a cable drum assembly for a power drive assembly for a vehicle sliding door is provided, the method comprising: inserting a pair of locating pins into a housing of a power drive assembly; inserting a gear into the housing, the pair of locating pins being received within a pair of locating holes of the gear; inserting a first drum configured for use as a front drum or a rear drum of the cable drum assembly into the housing, the pair of locating pins are also received within a first pair of locating holes of a first plurality of locating holes of the first drum; inserting a drive lug assembly into the gear and the first drum and at least one feature of the drive lug assembly is received within the first drum; inserting a second drum configured for use as a front drum or a rear drum of the cable drum assembly into the housing after the first drum has been inserted therein, the at least one feature of the drive lug assembly is received within an area defined by complimentary features of the second drum and the power drive assembly is configured for use on only one side of the vehicle and the first plurality of locating holes and the second plurality of locating holes each comprise a second pair of locating holes configured to align with each other when the second drum is inserted into another housing first and the first drum is inserted thereafter, the second pair of locating holes of the first and second drum having being arranged at a distance greater or less than the a distance between the first pair of locating holes of the first and second drum.

DETAILED DESCRIPTION OF EXEMPLARY EMBODIMENTS

Exemplary embodiments of the present invention relate to an apparatus and method for providing and installing a drum assembly of a power drive unit of a sliding door of a vehicle.

Prior apparatus and methods for providing and/or effectuating moving of a sliding door of a vehicle are found in U.S. Pat. Nos. 5,046,283; 5,313,795; 5,319,880; 5,319,881 and 5,323,570 the contents of which are incorporated herein by reference thereto.

Figure 1:
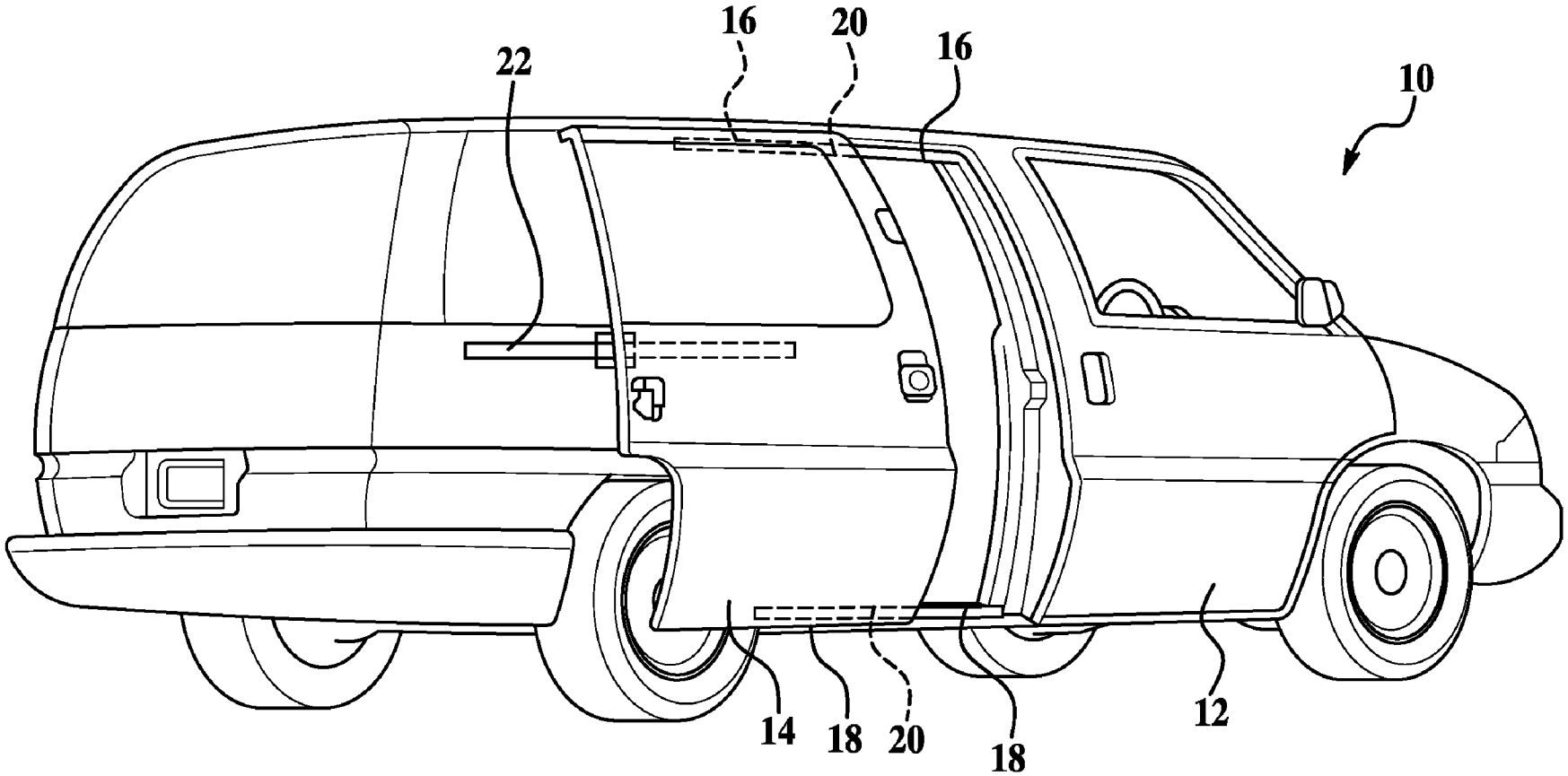
FIG. 1 is a perspective view of a vehicle with a sliding door

Referring now to FIG. 1, a vehicle 10 with a front pivoting door 12 and a power sliding door 14 is illustrated. Here power sliding door 14 is guided by rollers that are slidably received in an upper track 16 and a lower track 18. The rollers 20 are configured to be received in upper track 16 and lower track 18. In addition to upper track 16 and lower track 18, and in accordance with an exemplary embodiment, a center track 22 is also provided. Center track 22 is also configured to receive and engage a roller 20 that is coupled to sliding door 14. FIG. 1 illustrates a right hand power sliding door and it is understood that exemplary embodiments of the present invention are directed to a drum assembly and method of assembly for use in vehicles having either a left hand or right hand power sliding door or both.

Figure 2:
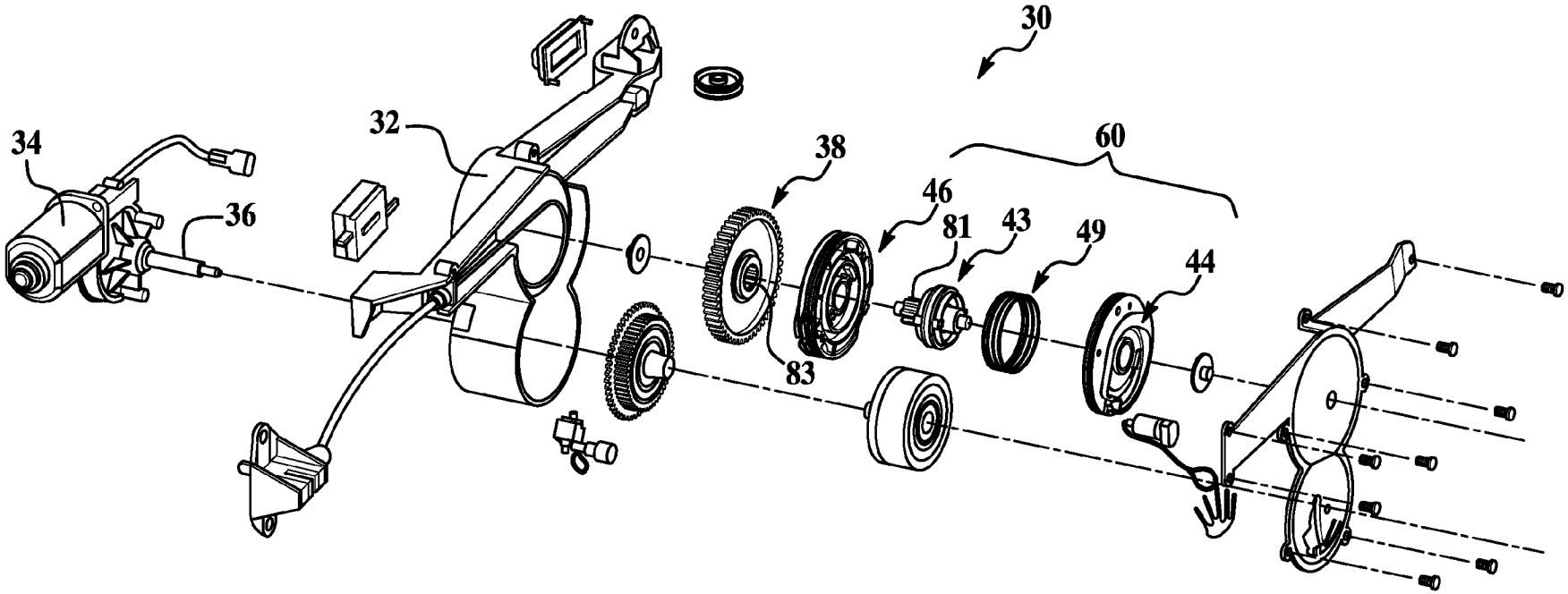
FIG. 2 is an exploded view of a right hand power drive unit having a drum assembly in accordance with an exemplary embodiment of the present invention.

Referring now to FIG. 2 an exploded view of a power sliding door system 30 of an exemplary embodiment of the present invention is illustrated. The power sliding door system illustrated in FIG. 2 is a right hand drive unit. The power sliding door system has a housing 32 configured to receive a motor 34 wherein a shaft 36 of the motor is intermittentingly coupled to a driven gear 38 via a clutch assembly 40. In order to drive a right hand sliding door a pair of cables are secured to a drum assembly 60 and a sliding door, wherein the drum is driven by a gear train selectively coupled to the motor by a clutch mechanism.

In accordance with an exemplary embodiment, the drum assembly of FIG. 2 comprises a first drum 44, a second drum 46 and a drive lug or drive lug assembly 43 and a spring 49 disposed therebetween. Spring 49 provides a biasing or rotational force between the two drums. In accordance with an exemplary embodiment of the invention the spring has a first end configured to engage a slot or opening in one of the drums and a second end configured to engage a slot or opening in the other one of the drums in the drum assembly. Thus, when spring 49 is secured between the drums and thereto the spring provides a rotational spring bias to the drums as they rotate with respect to each other. In accordance with one exemplary embodiment and referring to FIG. 2, the first drum is used as the rear drum and the second drum is used as the front drum for one side of the vehicle. First drum 44 has a cam feature 47 to provide a variable moment arm or cam feature configured to wrap up a portion of the cable on either side of the drum assembly (e.g., front or back depending on the assembly) and second drum 46 also has a cam feature 51 to provide a variable moment arm or cam feature configured to wrap up a portion of the cable on either side of the drum assembly (e.g., front or back depending on the assembly). As shown, the drums are very similar in shape and size thus, exemplary embodiments of the present invention provide the advantages of using only a pair of drums for use as either a right hand side or left hand side drum assembly, wherein the drums themselves are configured to be assembled in an error proof manner.

In addition, and in accordance with an exemplary embodiment the rear drum and the front drum of the right hand drive unit are interchangeable as the front drum and rear drum, respectively of a drum assembly used for a left hand drive unit.

In one non-limiting exemplary embodiment, a pair of cables are secured to a hinge or roller assembly or other appropriate location of a sliding door (e.g., points of cable securement to the sliding door), wherein one cable is secured to a forward side of the hinge and the other is secured to the rearward side of the hinge and the other ends of the cables are each secured to the drum assembly (e.g., one end of one cable to the front drum and one end of the other cable to the rear drum). The cables are attached to the drum assembly such that while one cable raps off the drum the other will rap on.

Figure 3:
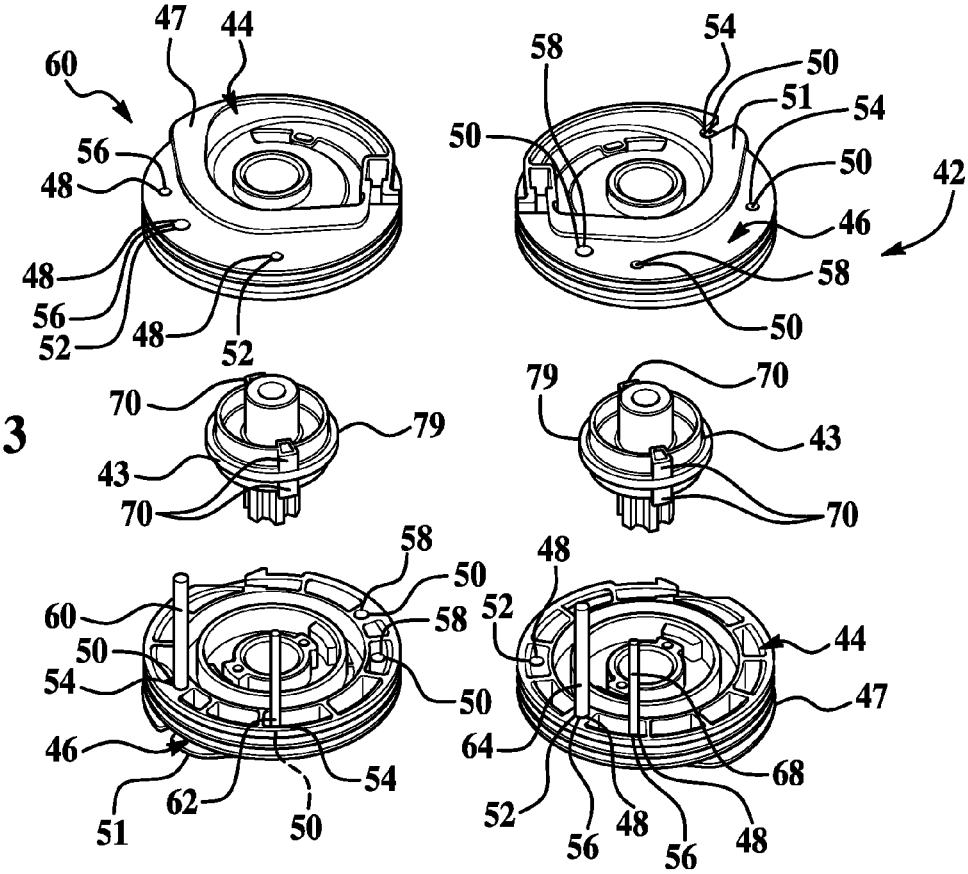
FIG. 3 shows exploded views of drum assemblies constructed in accordance with exemplary embodiments of the present invention.

Referring now to FIG. 3, the front drum, rear drum and drive lug of a drum assembly 60 for a right hand drive unit and a front drum, rear drum and drive lug of a drum assembly 42 for a left hand drive unit is illustrated. In accordance with an exemplary embodiment, the rear drum 44 of the right hand drum assembly can be used as the front drum of drum assembly 60 (e.g., the left hand drum assembly) and the front drum 46 of the right hand drum assembly can be used as the rear drum of drum assembly 60 (e.g., the left hand drum assembly).

In order to assemble either the right hand drum assembly or the left hand drum assembly each of the drums 44 and 46 have a plurality of locating holes or openings, which are configured to temporarily receive locating pins of a tool during assembly of the motor drive unit. In accordance with an exemplary embodiment the locating pins of the tool are specifically configured for the contemplated use (e.g., left hand drive unit or right hand drive unit). In other words, the pin locations of the tools for the left hand drive unit are different than the pin locations for the right hand drive unit. Thus, only the correct drum arrangement (e.g., first drum used as the front drum and the second drum used as the rear drum and vice versa) can be used for either assembly. After assembly of the motor drive unit on the tool and connection of the cables the housing is removed from the tool and the locating pins are removed from the openings in the drum or drums. For example, drum 44 has a first plurality of locating holes or openings 48 and drum 46 has a second plurality of locating holes or openings 50.

In accordance with an exemplary embodiment, the first plurality of locating holes 48 have a first pair of locating holes 52 configured to align with a first pair of location holes 54 of the second plurality of locating holes when the first drum 44 is used a rear drum of the drum assembly and the second drum 46 is used as a front drum of the drum assembly. Moreover, these holes will align with the locating pins of the assembly tool. In addition, the first plurality of locating holes have a second pair of locating holes 56 configured to align with a second pair of location holes 58 of the second plurality of locating holes when drum 46 is used a rear drum of the drum assembly and drum 44 is used as a front drum of the drum assembly.

In accordance with an exemplary embodiment and in order to provide an error proof method for assembly of either a left hand drum assembly or a right hand drum assembly the first pair of locating holes of the first plurality of locating holes and the first pair of location holes of the second plurality of locating holes include a larger sized opening and a smaller sized opening, each of which are configured to receive a pair of locating pins 60 and 62 (one large, one small, e.g., one having a larger diameter than the other) positioned to align drum 44 with drum 46. In addition, the holes of these two pairs of openings are positioned a first distance apart from each other, the first distance being greater or less than a distance the holes of the other two pairs of opening are positioned away from each other thus, corresponding to the specific configuration of the locating pins of the tools. Accordingly and due to the size of the pairs of openings and their locations as well as the size and position of locating pins secured to an assembly tool as will be discussed below, an error proof assembly process is provided.

In accordance with an exemplary embodiment, pins 60 and 62 are located on a tool configured to temporarily receive the motor drive unit during assembly. Accordingly, the pins first pass through openings in the housing and then are used as locating features for the gear, the rear drum and possibly the front drum. Thereafter, and once the relevant assembly is complete the motor drive unit with the drum assembly installed therein is removed from the tool and the pins are removed from the locating holes.

In addition, the larger and smaller pins and their locations also provide a means for error proof assembly as only the correct rear drum can be inserted into the housing (e.g., left or right), which has the appropriate locating pins inserted therein. In addition, the tool or tools are each specifically configured for either the left or right hand drive assembly thus, the pins are orientated such that only the correct rear drum can be inserted into the appropriate housing and thereafter only the correct front drum can be installed on top of the rear drum as the locating pins will have to pass through the locating openings of the drum otherwise the drums will not be able to be inserted into the housing.

In addition and in order to reverse the assembly, the second pair of locating holes of the first plurality of locating holes and the second pair of location holes of the second plurality of locating holes also include a larger sized opening and a smaller sized opening, each of which are configured to receive a pair of locating pins 64 and 68 (one large, one small, e.g., one having a larger diameter than the other) positioned to align drum 44 with drum 46. Moreover, and in order to provide an error proof assembly, the distance between the first pair of locating holes of the first plurality of locating holes and the first pair of location holes of the second plurality of locating holes is different from the second pair of locating holes of the first plurality of locating holes and the second pair of location holes of the second plurality of locating holes. In addition, the corresponding locating pins of the corresponding tools are arranged for these specific configurations (e.g., one for the right hand assembly and one for the left hand assembly). Thus, when using the tools for the left and right hand assemblies error proof assembly is provided.

In addition, and in one exemplary embodiment drum 44 only has three openings 48, one of which is a larger opening used in both the first pair of locating holes 52 of the first plurality of locating holes and the second pair of locating holes 56 of the first plurality of locating holes. On the other hand drum 46 has four openings or second plurality of locating holes 50 in which two pair of locating holes are provided (54 and 58) each of which has a larger opening configured to receive the larger locating pin. Of course, the size, number and configuration of the locating holes and locating pins for each of the tools (left and right) may vary to be greater or less than the aforementioned number of pairs and corresponding holes and locating pins.

In accordance with an exemplary embodiment, the height of the locating pins can pass entirely through both drums 44 and 46 or only the first drum or rear drum inserted into the housing as the locating openings can be visually aligned with the locating pins or alternatively the drive lug assembly only provides one of two orientations the front drum can be received upon the drive lug assembly and since the cable being secured to the front drum can only be secured in one of the two orientations the assembly becomes error proof. In yet another alternative only one of the locating pins may have a length from the tool sufficient to pass through the housing, the gear, the rear drum and the front drum.

Figure 7:
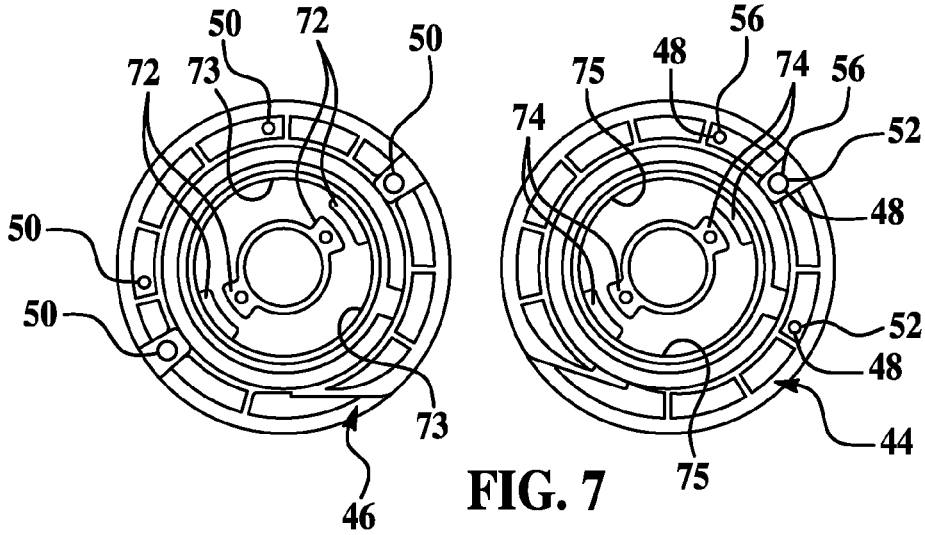
Figure 15:
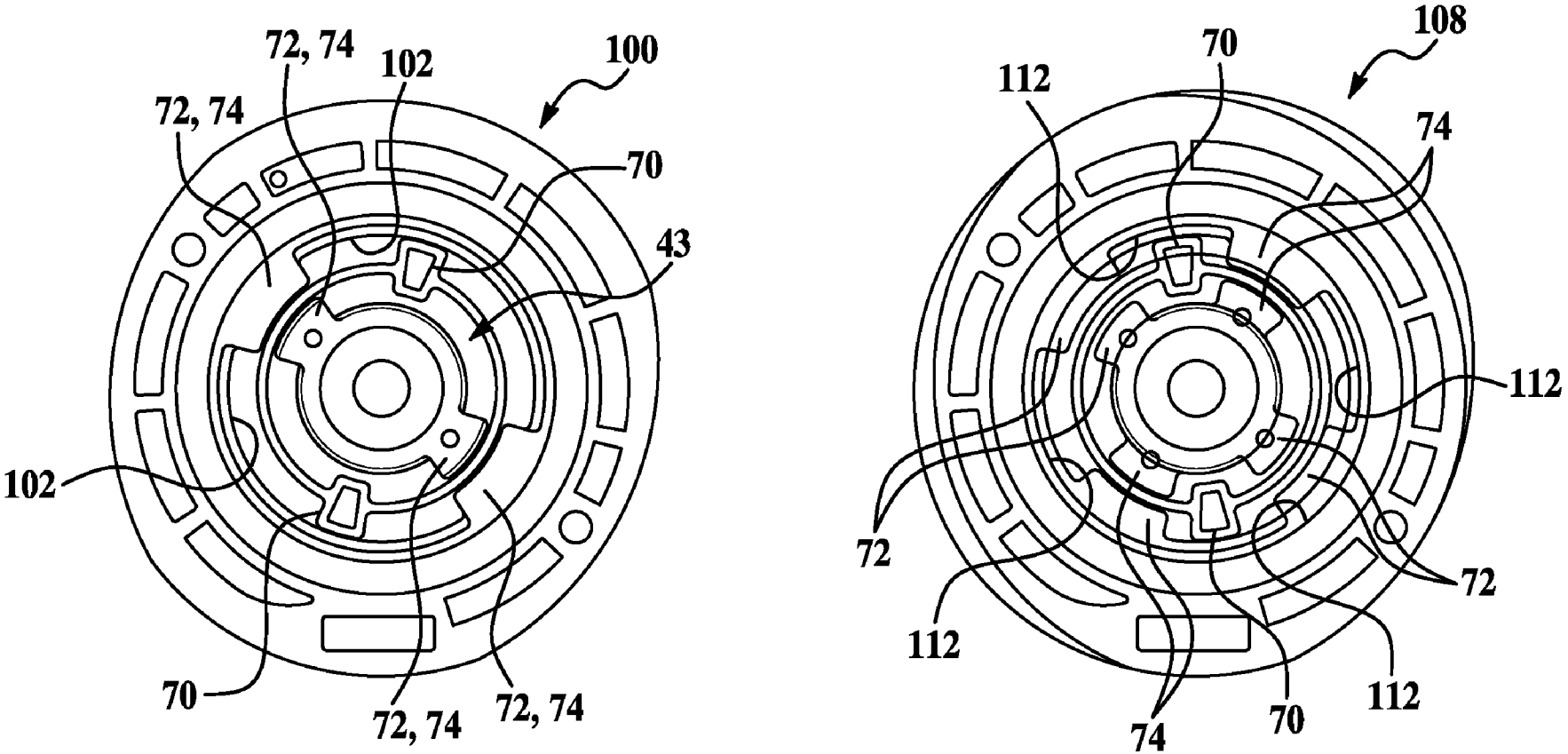
FIG. 15 illustrates the difference of the assembly of the drums in accordance with an exemplary embodiment of the present invention.

The alignment features 70 of the drive lug assembly are shown in at least FIG. 3, while complimentary features 72 of drum 46 and features 74 of drum 44 are at least shown in FIG. 7. Features 72 define a pair of areas 73 for receipt of features 70 when a portion of the drive lug assembly is inserted into drum 46 and features 74 define a pair of areas 75 for receipt of features 70 when another portion of the drive lug assembly is inserted into drum 44. It being understood that features 70 depend away from a peripheral wall portion 79 of the drive lug and the wall portion of the drive lug is able to rotate within drum 44 and drum 46 until features 72 contact features 72 and 74 of the drums. It is also understood that the drive lug is secured to the gear by a plurality of teeth 81 that are received within a slotted opening 83 of the gear thus, rotation of the gear causes rotation of the drive lug and then ultimately the drums once features 72 contact features 72 and 74 of the drums. The rotation of drums 44 and 46 relative to each other and the insertion of spring 49 into openings of each drum 44 and 46 allows spring biased rotation of the drums with respect to each other to allow for proper cable tension and assembly. In addition, and in accordance with an exemplary embodiment the locating pins and holes of the drums will align the same so that the drive lug and the drums 44 and 46 are only positioned in one possible arrangement, which corresponds to either a right hand or left hand drive assembly and wherein only two receiving areas are provided for the drive lug thus, providing error proof assembly. FIG. 15 further illustrates the error proof assembly of exemplary embodiments of the present invention.

In addition and as an alternative embodiment, the locating pins of the tool are of a sufficient length to extend all the way through gear 38, drum 44 and drum 46.

Figure 4:
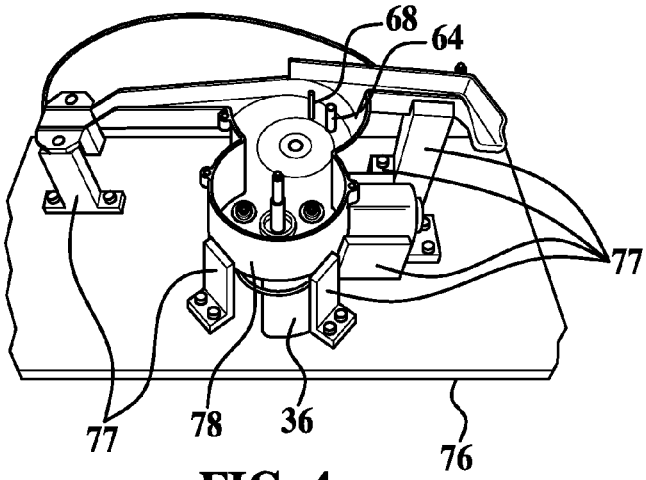
FIGS. 4 and 5 illustrate a power drive unit housing and a locating tool in accordance with an exemplary embodiment of the present invention.
Figure 5:
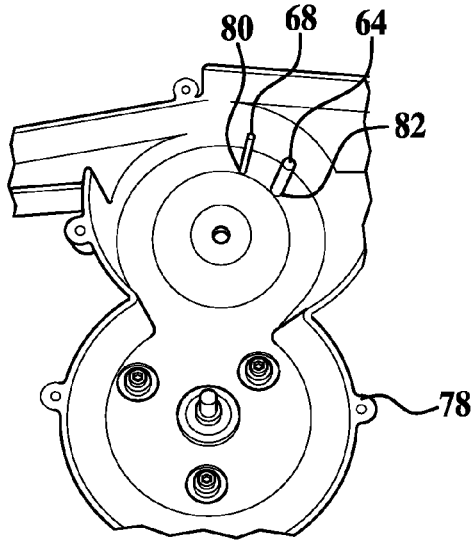

Referring now to FIGS. 4 and 5 a tool 76 having locating pins 64 and 68 is illustrated. Also shown is a left hand drive unit housing 78 having a pair of locating openings 80 and 82 configured to receive locating pins 64 and 68 therein. Tool 76 is configured for use with a left hand drive unit housing wherein locating features 77 and pins 64 and 68 are specifically orientated for use with the configuration of the left hand drive unit housing. In other words, a right hand drive unit housing would not fit into tool 76 thus, a separate tool with locating pins is provided for the right hand drive unit housing. In accordance with an exemplary embodiment, the housing is first placed upon the tool and the pins pass through openings in the housing. Thereafter, the gear is inserted therein and then the rear drum is inserted therein, if the wrong drum is inserted the pins of the appropriate tool (left or right) will prevent insertion and installation of the rear drum thus, error proof assembly is provided. Once the correct drum is inserted in first, the pins or drive lug features or both provide a means of allowing only the correct front drum to be installed therein. In addition, the drive lug provides a means for securing the rear drum to the gear as well as the front drum. Once again, error proof assembly is provided. The use of the locating pins prevents the wrong drum from being inserted as the rear drum and the front drum since and in accordance with an exemplary embodiment the rear drum of one assembly (left side) can be used as the front drum of another assembly (right side) and the rear drum of the other assembly (right side) can be used as the front drum of other assembly (left side) thus, locating pins of the tools (left and right) are received in arranged locating holes of the front and rear drums.

Thereafter, and once the relevant assembly is complete the motor drive unit with the drum assembly installed therein is removed from the tool and the pins are removed from the locating holes. A cover is mounted to the housing and the cable drum assembly is rotatably received and secured therein.

Figure 6:
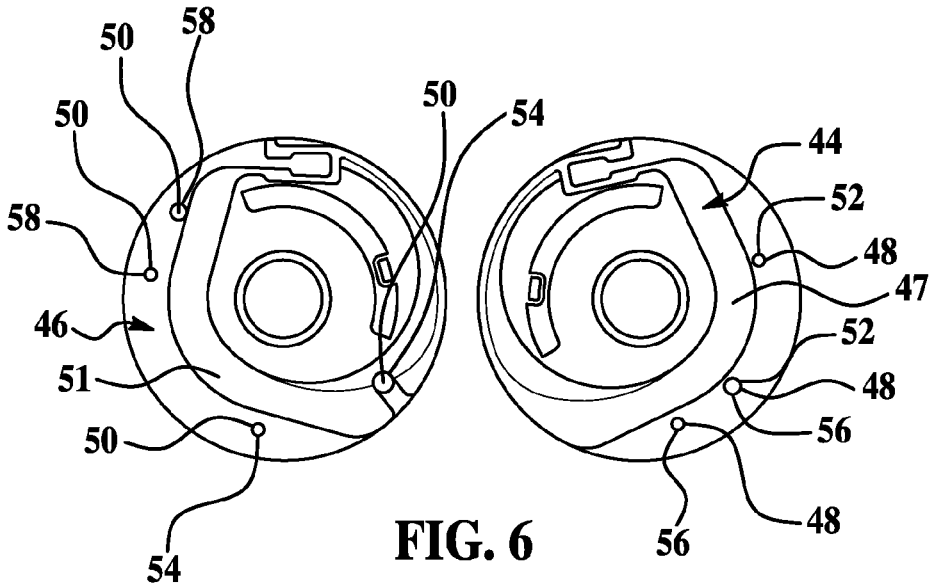
FIGS. 6-8 illustrate a drum assembly in accordance with an exemplary embodiment of the present invention.
Figure 8:
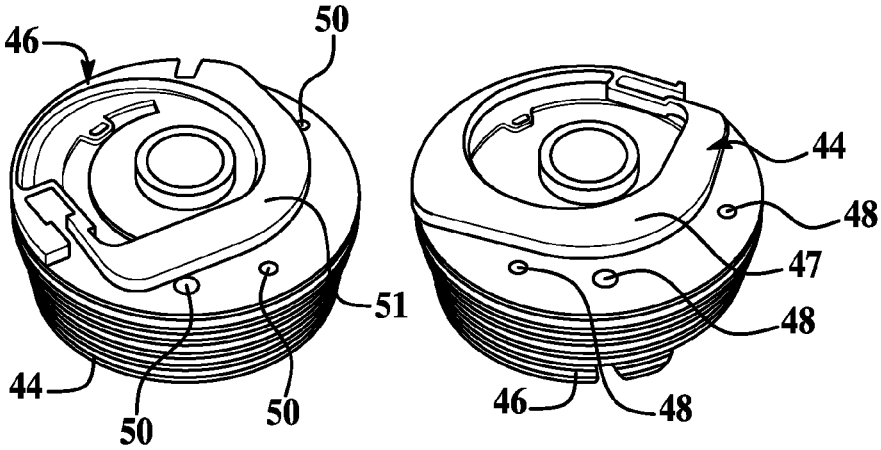

FIGS. 6-8 illustrate a left hand drum configuration and a right hand drum configuration as well as either side of both drums 44 and 46.

Figure 9:
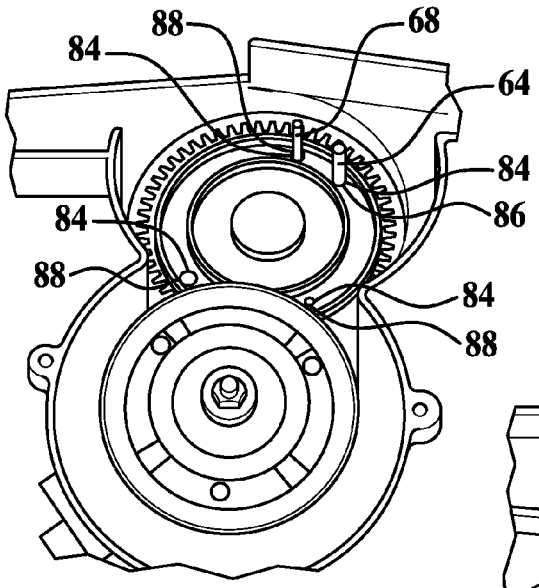
FIGS. 9-12 illustrate an assembly sequence of a power drive unit housing and a drum assembly in accordance with an exemplary embodiment of the present invention.
Figure 10:
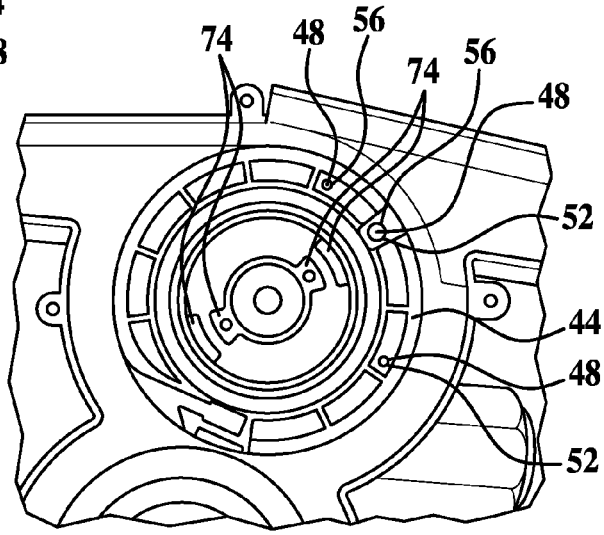
Figure 11:
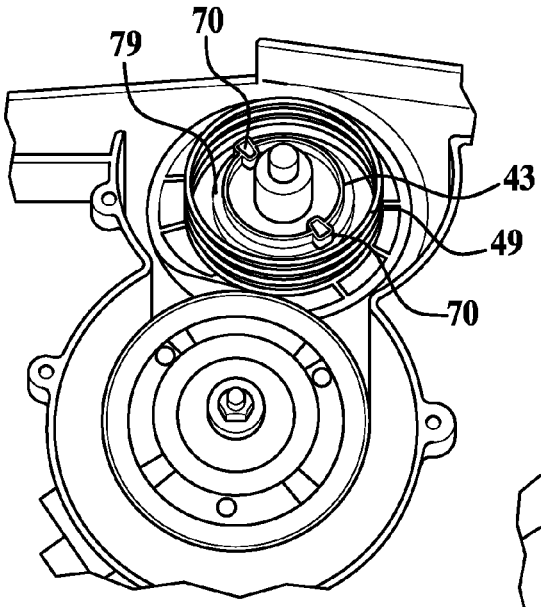
Figure 12:
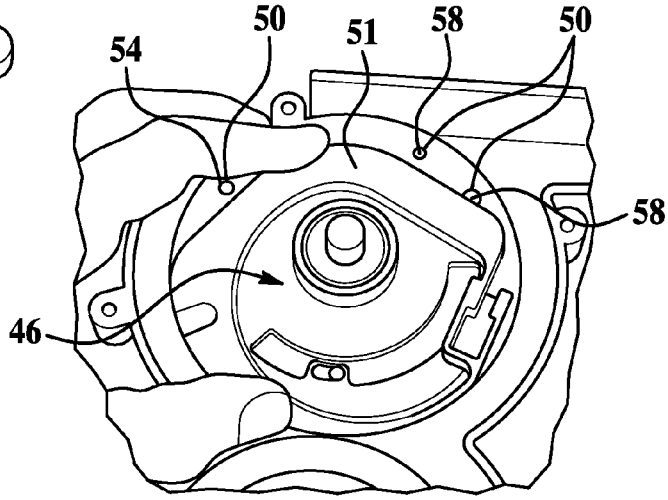

FIG. 9 illustrates the driven gear inserted into the motor drive unit housing wherein the driven gear also has a plurality of locating openings 84 having a first pair 86 and second pair 88 of openings configured to receive either pair of location pins (e.g., left hand or right hand assembly tool) of the locating tool as the pins for a left hand assembly tool are orientated differently from the pins of a right hand assembly tool. Nevertheless, the gear is configured to receive either pair of pins. Thus, gear 24 is useable in both assemblies as well as the drive lug and the spring. As shown in FIG. 9, the driven gear is inserted therein and then the rear drum is loaded in (FIG. 10) each of which has the locating pins received in the complimentary locating holes. After that the drive lug assembly and the spring is inserted on top of the rear drum and the outer drum is then placed over the drive lug assembly, the spring and the rear drum. As illustrated, pins 64 and 68 provide locating features for the driven gear and the rear drum. In addition, and in an alternative embodiment, the locating pins can extend outward to be received within the front drum or alternatively only one pin may extend all the way to the front drum as long as the proper error proofing is provided.

Although a single tool is shown for the assembly of the left hand motor drive unit it is, of course, understood that a tool for a right hand motor drive unit is provided wherein locating pins 60 and 62 are configured to be received within the first pair of location holes 54 of the second plurality of locating holes when the first drum is used a rear drum of the drum assembly and the second drum is used as a front drum of the drum assembly.

Figure 13:
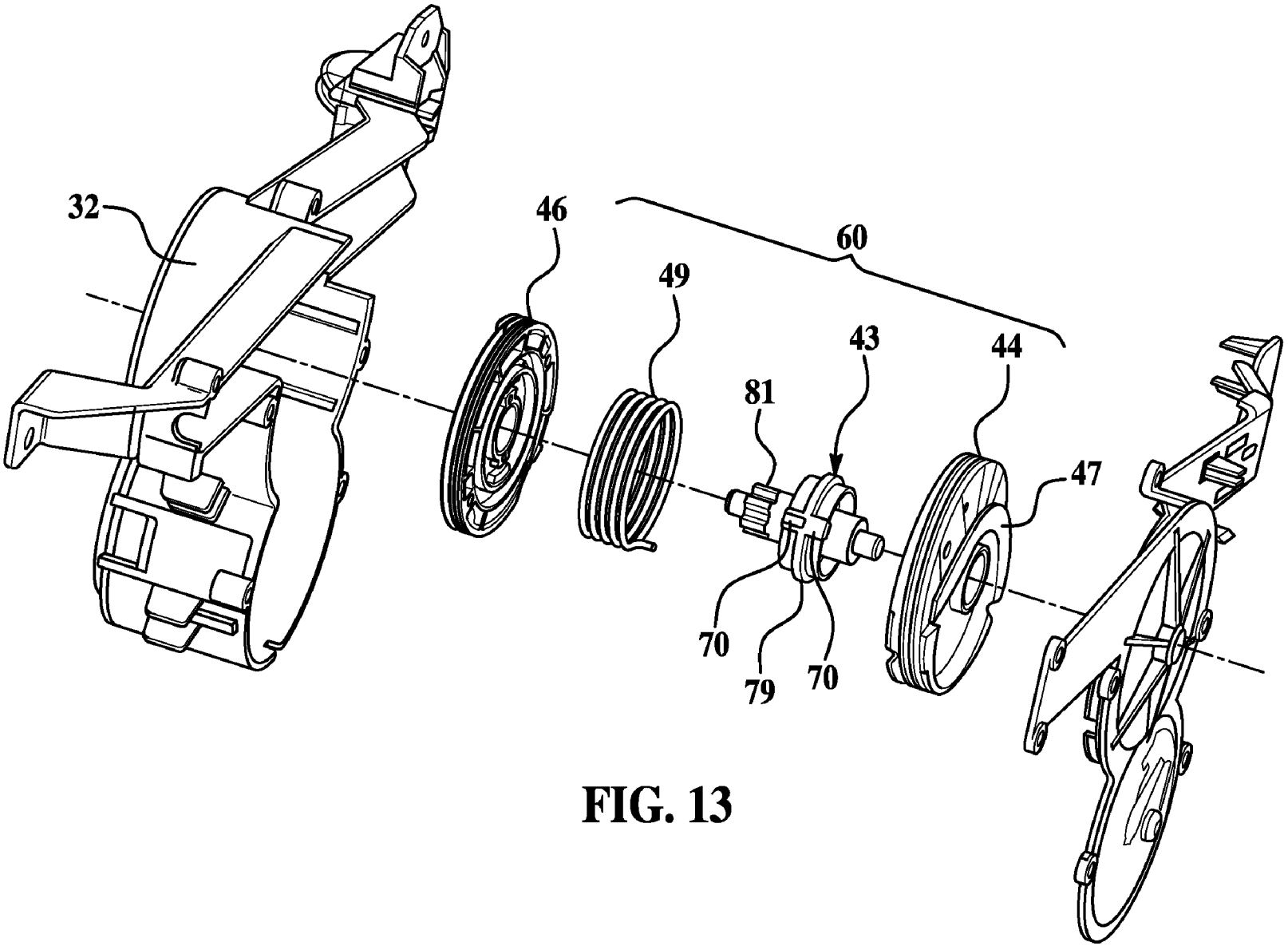
FIG. 13 is an exploded view of a portion of a right hand power drive unit having a drum assembly in accordance with an exemplary embodiment of the present invention.
Figure 14:
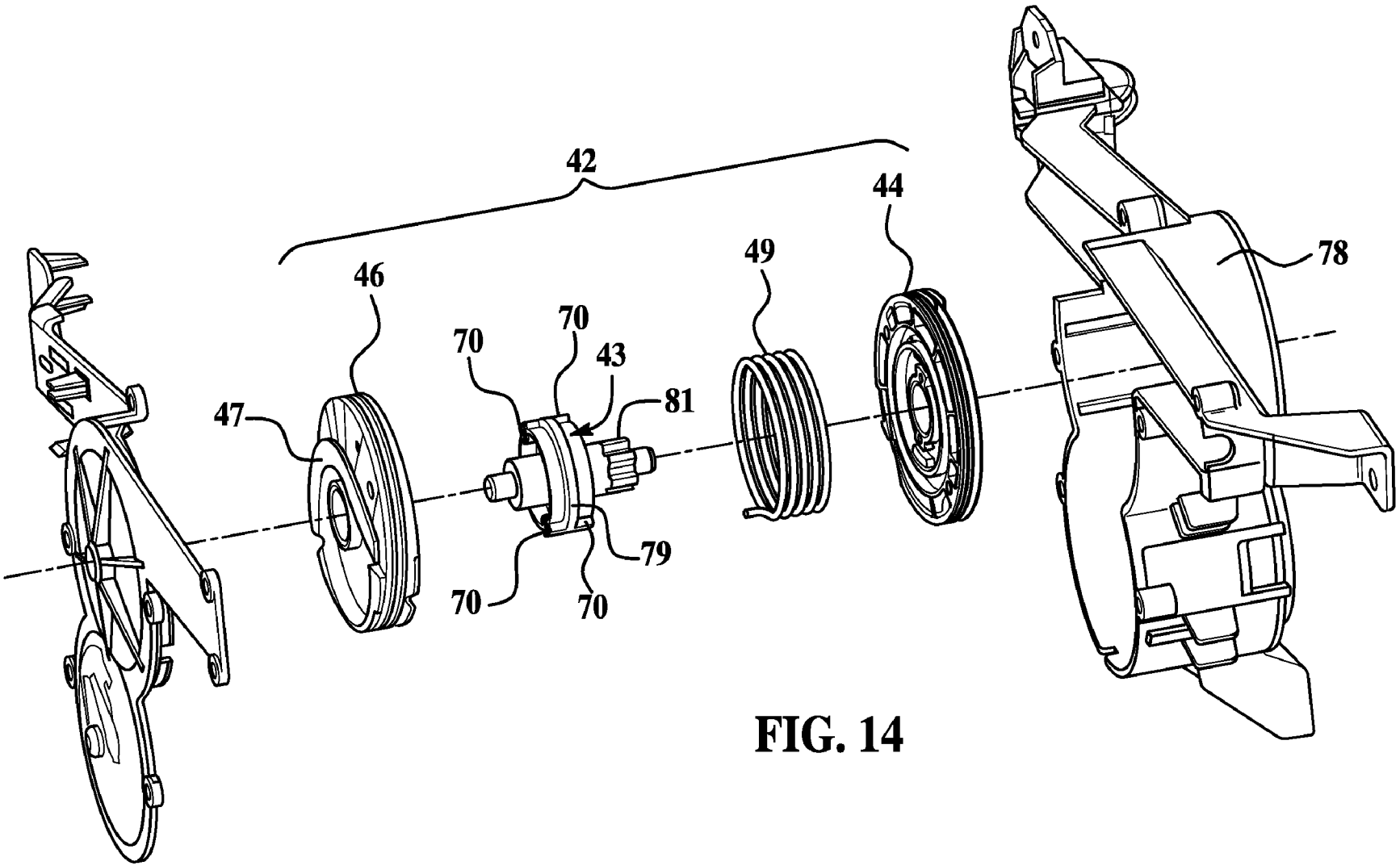
FIG. 14 is an exploded view of a portion of a left hand power drive unit having a drum assembly in accordance with an exemplary embodiment of the present invention.

FIG. 13 illustrates an exploded view of a right hand side drive assembly comprising housing 32 and drum assembly 42. Again, drum assembly 42 comprises a rear drum 46, a drive lug assembly 43, a spring 49, and a front drum 44. FIG. 14 illustrates an exploded view of a portion of a left hand side drive assembly comprising housing 32 and drum assembly 42. Again, drum assembly 60 comprises a rear drum 44, a drive lug assembly 43, a spring 49, and a front drum 46.

In accordance with an exemplary embodiment and by using just two parts (front drum and rear drum) for both the left and right hand drive assemblies the associated costs and tooling are minimized. The drums are used with many common parts (drive lug assembly) and symmetrically opposite parts (spring). In accordance with an exemplary embodiment, the drums are assembled in opposite hand (left and right) assemblies with 180-degree difference between right hand and left hand. Tensioning the springs of the cable assemblies or cable secured to the drums 90 degrees causes the drums to rotate and reach a similar position for front and rear drums thus minimizing cable interchange.

In accordance with an exemplary embodiment, each of the drums is configured to have features to engage a complimentary feature of the drive lug. Proper size and location of those features allows only one position of the drive lug during assembly. In contrast, the drive lug of other systems may be installed in two locations one of which is incorrect.

In accordance with an exemplary embodiment and in order to prevent the drums from being incorrectly installed in the housings, the drums have locating holes for locating pins wherein the left hand drive assembly is used with a tool having a pair of locating pins positioned such that only the correct drum may be installed first and thereafter only the proper drum may be inserted second. Similarly, the right hand drive assembly is used with another tool having a pair of locating pins positioned such that only the correct drum may be installed first, wherein the first installed drum is one assembly is also configured to be installed last in the other assembly.

FIG. 15 illustrates the difference of the assembly of the drums in accordance with an exemplary embodiment of the present invention. For example, a drum assembly 100 is illustrated in accordance with an exemplary embodiment of the present invention. Drum assembly 100 is a cross sectional view through one of the drums in order to illustrate the alignment of the features of the drums. Drum assembly 100 shows that when assembled in the tool with the locating pins passing through the appropriate holes or openings the features of each drum (72, 74) configured to engage a complimentary feature 70 of the drive lug are aligned so that only two receiving areas 102 are provided wherein the two pairs of features 70 of the drive lug must be received therein thus assembly 100 provides only one possible orientation of the drive lug. It being understood that areas 102 are defined by areas 73 and 75 of drums 46 and 44 when the two are positioned on top of each other and the locating openings are aligned for receipt of the locating pins therein.

In contrast, the drive lug of other systems (e.g., drums without locating openings and tools with pins for right and left hand assembly) may be installed in two locations one of which is incorrect. One such configuration is illustrated in FIG. 15 namely drum assembly 108. Drum assembly 108 is a cross sectional view through one of the drums in order to illustrate the miss-alignment of the features of the drums (e.g., no locating openings or locating pins). Drum assembly 108 shows that when assembled in the tool without locating pins passing through the appropriate holes or openings the features of each drum (72, 74) are misaligned so that only four receiving areas 112 are provided wherein the two pairs of features 70 of the drive lug may be received in any two of the four receiving areas thus assembly 108 provides multiple orientations of the drive lug. It being understood that areas 108 are defined by areas 73 and 75 of drums 46 and 44 when the two are positioned on top of each other and there are no locating openings for receipt of the locating pins therein.

Accordingly, and since both the front drum and the rear drum have features to provide a variable moment arm or cam feature configured to wrap up a portion of the cable on either side of the drum assembly the drums are very similar in shape and size thus, exemplary embodiments of the present invention provide the advantages of using only a pair of drums for use as either a right hand side or left hand side drum assembly, wherein the drums themselves are configured to be assembled in an error proof manner.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

What is claimed is:

1. A cable drum assembly for a power drive assembly for a vehicle sliding door, the cable drum assembly comprising:

a first drum configured for use as a front drum or a rear drum of the cable drum assembly, the first drum comprising a first plurality of locating holes having a first pair of locating holes spaced apart a first distance and a second pair of location holes spaced apart a second distance, the first distance different from the second distance; and a second drum configured for use as a front drum or a rear drum of the cable drum assembly, the second drum comprising a second plurality of locating holes having a second pair of locating holes spaced apart the second distance and a first pair of location holes spaced part the first distance;

wherein in a first configuration, the first pair of locating holes align with the first pair of location holes when the first drum is used as a rear drum of the drum assembly and the second drum is used as a front drum of the drum assembly; and wherein in a second configuration, the second pair of locating holes align with the second pair of location holes when the first drum is used as a front drum of the drum assembly and the second drum is used as a rear drum of the drum assembly.

2. The cable drum assembly as in claim 1, further comprising a drive lug inserted between the first drum and the second drum, the drive lug being configured for use with the drive assembly when either the first drum or the second drum is used as a front drum of the cable drum assembly and the second drum is used as either the rear drum of the cable drum assembly and the drive lug has at least one feature configured to be received within an area defined by complimentary features of the first drum and the second drum.

3. The cable drum assembly as in claim 2, further comprising a spring inserted between the first drum and the second drum, the spring being configured for use with the drive assembly when either the first drum or the second drum is used as a front drum of the cable drum assembly and the second drum is used as either the rear drum of the cable drum assembly.

4. The cable drum assembly as in claim 1, wherein the first drum and the second drum each have a cam feature configured on an exterior surface, the cam feature being used as either as a front cam feature or a rear cam feature of the cable drum assembly.

5. The cable drum assembly as in claim 1, wherein a first hole of the first pair of locating holes is shaped differently than a second hole of the first pair of locating holes, and a first hole of the second pair of location holes is shaped differently than a second hole of the second pair of location holes.

6. The cable drum assembly as in claim 5, wherein a first hole of the second pair of locating holes is shaped differently than a second hole of the second pair of locating holes, the first hole of the second pair of locating holes shaped the same as the first hole of the second pair of location holes, and a first hole of the first pair of location holes is shaped differently than a second hole of the first pair of location holes, the first hole of the first pair of location holes shaped the same as the first hole of the first pair of locating holes.

7. The cable drum assembly as in claim 6, further comprising a drive lug inserted between the first drum and the second drum, wherein the drive lug is configured for use with the drive assembly when either the first drum or the second drum is used as a front drum of the cable drum assembly and the second drum is used as either the rear drum of the cable drum assembly, wherein the drive lug has at least one feature configured to be received within an area defined by complimentary features of the first drum and the second drum.

8. The cable drum assembly as in claim 7, further comprising a spring inserted between the first drum and the second drum, the spring being configured for use with the drive assembly when either the first drum or the second drum is used as a front drum of the cable drum assembly and the second drum is used as either the rear drum of the cable drum assembly.

9. The cable drum assembly as in claim 7, wherein the first drum and the second drum each have a cam feature configured on an exterior surface, the cam feature being used as either as a front cam feature or a rear cam feature of the cable drum assembly.

10. The cable drum assembly as in claim 1, wherein a first hole of the second pair of locating holes is shaped differently than a second hole of the second pair of locating holes, and a first hole of the first pair of location holes is shaped differently than a second hole of the first pair of location holes.

11. The cable drum assembly as in claim 10, further comprising a drive lug inserted between the first drum and the second drum, the drive lug being configured for use with the drive assembly when either the first drum or the second drum is used as a front drum of the cable drum assembly and the second drum is used as either the rear drum of the cable drum assembly, wherein the drive lug has at least one feature configured to be received within a complimentary feature of the first drum and the second drum; and a spring inserted between the first drum and the second drum, the spring being configured for use with the drive assembly when either the first drum or the second drum is used as a front drum of the cable drum assembly and the second drum is used as either the rear drum of the cable drum assembly.

12. The cable drum assembly as in claim 1, wherein three holes comprise the first plurality of locating holes and the first pair of locating holes and the second pair of location holes share a common hole that is shaped differently than the other holes of the first plurality of locating holes.

13. The cable drum assembly as in claim 12, wherein four holes comprise the second plurality of locating holes and a first hole of the second pair of locating holes is shaped differently than a second hole of the second pair of locating holes, and a first hole of the first pair of location holes is shaped differently than a second hole of the first pair of location holes, and the drum assembly further comprises a drive lug inserted between the first drum and the second drum, the drive lug being configured for use with the drive assembly when either the first drum or the second drum is used as a front drum of the cable drum assembly and the second drum is used as either the rear drum of the cable drum assembly and the drive lug has at least one feature configured to be received within an area defined by complimentary features of the first drum and the second drum.

14. The cable drum assembly as in claim 13, wherein the first drum and the second drum each have a cam feature configured on an exterior surface, the cam feature being used as either as a front cam feature or a rear cam feature of the cable drum assembly.

15. A cable drum assembly for a power drive assembly for a vehicle sliding door, the cable drum assembly comprising:

a first drum configured for use as a front drum or a rear drum of the cable drum assembly, the first drum comprising a first plurality of locating holes having a first pair of locating holes with a first hole of the first pair of locating holes shaped differently than a second hole of the first pair of locating holes, and a second pair of location holes with a first hole of the second pair of location holes shaped differently than a second hole of the second pair of location holes; and a second drum configured for use as a front drum or a rear drum of the cable drum assembly, the second drum comprising a second plurality of locating holes having a second pair of locating holes with a first hole of the second pair of locating holes shaped differently than a second hole of the second pair of locating holes, the first hole of the second pair of locating holes shaped the same as the first hole of the second pair of location holes, and a first pair of location holes with a first hole of the first pair of location holes shaped differently than a second hole of the first pair of location holes, the first hole of the first pair of location holes shaped the same as the first hole of the first pair of locating holes;

wherein in a first configuration, the first pair of locating holes align with the first pair of location holes when the first drum is used as a rear drum of the drum assembly and the second drum is used as a front drum of the drum assembly; and wherein in a second configuration, the second pair of locating holes align with the second pair of location holes when the first drum is used as a front drum of the drum assembly and the second drum is used as a rear drum of the drum assembly.

16. The cable drum assembly as in claim 15, further comprising a drive lug inserted between the first drum and the second drum, the drive lug being configured for use with the drive assembly when either the first drum or the second drum is used as a front drum of the cable drum assembly and the second drum is used as either the rear drum of the cable drum assembly and the drive lug has at least one feature configured to be received within an area defined by complimentary features of the first drum and the second drum.

17. The cable drum assembly as in claim 16, further comprising a spring inserted between the first drum and the second drum, the spring being configured for use with the drive assembly when either the first drum or the second drum is used as a front drum of the cable drum assembly and the second drum is used as either the rear drum of the cable drum assembly.

18. The cable drum assembly as in claim 15, wherein the first drum and the second drum each have a cam feature configured on an exterior surface, the cam feature being used as either as a front cam feature or a rear cam feature of the cable drum assembly.

19. The cable drum assembly as in claim 15, wherein three holes comprise the first plurality of locating holes and the first hole of the first pair of locating holes is the same as the first hole of the second pair of location holes.

20. The cable drum assembly as in claim 15, wherein the first hole of the first pair of locating holes is larger than the second hole of the first pair of locating holes, the first hole of the second pair of location holes is larger than the second hole of the second pair of location holes, the first hole of the second pair of locating holes is larger than the second hole of the second pair of locating holes, the first hole of the second pair of locating holes is sized the same as the first hole of the second pair of location holes, and the first hole of the first pair of location holes is larger than the second hole of the first pair of location holes, the first hole of the first pair of location holes is sized the same as the first hole of the first pair of locating holes.

* * * * *